United States Patent [19]

Chung et al.

[11] Patent Number: 4,545,180

[45] Date of Patent: Oct. 8, 1985

[54] METHOD AND APPARATUS FOR MAKING AND FILLING PACKETS WITH A PRODUCT

[75] Inventors: Yun H. Chung; Dennis E. Chung, both of Rossford, Ohio

[73] Assignee: MPR Corporation, Perrysburg, Ohio

[21] Appl. No.: 450,275

[22] Filed: Dec. 16, 1982

[51] Int. Cl.[4] ..... B65B 57/04; B31B 33/74

[52] U.S. Cl. ..... 53/456; 53/479; 53/562; 53/575

[58] Field of Search ..... 53/202, 373, 455, 456, 53/459, 479, 562, 568, 575, 551, 552

[56] References Cited

U.S. PATENT DOCUMENTS

| | | | |
|---|---|---|---|
| 2,269,533 | 1/1942 | Howard . | |
| 2,691,259 | 10/1954 | Weckesser | 53/553 |
| 2,827,742 | 3/1958 | Bursak . | |
| 3,028,789 | 4/1962 | Neuendorf et al. . | |
| 3,382,644 | 5/1968 | Vogt . | |
| 3,646,726 | 3/1972 | Hutcheson | 53/455 |
| 3,688,465 | 9/1972 | Benitez et al. | 53/562 |
| 3,739,522 | 6/1973 | Greenbaum | 53/562 |
| 3,855,907 | 12/1974 | Johnson et al. | 53/562 |
| 4,216,639 | 8/1980 | Gautier | 53/413 |

*Primary Examiner*—W. D. Bray

*Attorney, Agent, or Firm*—Fraser & Clemens

[57] ABSTRACT

A machine for making and filling packets has an intermittently fed sheet material which is recurrently severed into packet strips. These strips are successively pushed downwardly by a battery of filling tubes which shift vertically, bear against the sheet strip, and fold it into a vertical trough-shaped receptacle open at the top. After the filling tube battery has moved downwardly, sets of vertically spaced sealing or clamping jaws operate to effect laterally spaced side seals in an upper strip and conjointly create top seals in the lower or preceding sheet strip. Product is metered to the packet strips. The sealed packets are severed from the strip after the sealing operation. The filled packet has outwardly bowed side walls and the juncture of the bottom wall and the side walls will assume a line, the configuration of which is a function of the size and cross-sectional configuration of the filling tubes, providing a unique advantageous form.

10 Claims, 17 Drawing Figures

METHOD AND APPARATUS FOR MAKING AND FILLING PACKETS WITH A PRODUCT

BACKGROUND OF THE INVENTION

Machines for making and filling packets containing flowable or pulverulent materials such as sugar and catsup, for example, have been used to a great degree of satisfaction, and one such machine is set forth in U.S. Pat. No. 3,404,506 of Oct. 8, 1968. However, it is a desideratum not only to improve the efficiency of such machines to the end that greater production is achieved and simpler and more reliable machines and methods are secured, but also that a more satisfactory packet is produced. Currently the speed of production has not been such that an acceptable profit margin has been had and machine maintenance has been a real problem. The packets heretofore produced have been of conventional type and are noteworthy in their limited capacity and somewhat objectionable conformation.

SUMMARY OF THE INVENTION

A machine, a method, and a novel packet are produced in which the machine is simple in structure and efficient in operation; the method is unique, time saving, and fast; and the product has improved features as to capacity and ease of handling, storage, and display. The filling and forming tube through which the product is metered influences the shape of the packet because it has a unique form around which the packet sheet material is applied so as to form a pouch or cavity having curvilinear side walls of outwardly bowed form, associated end walls, and a bottom wall having depending ears at opposed ends thereof. Such packet has greater capacity so that more of the product can be fed to it. Then, too, the packet has a conformation or configuration better suited for handling, storage, and display purposes. The machine has side sealing jaws and top sealing jaws which may work together, one packet strip being sealed to provide the side seals of the packets at the same time and an advanced packet strip has top packet sealing effected. If desired, the side and top sealing jaws may be operated independently of one another.

BRIEF DESCRIPTION OF THE DRAWINGS

A preferred embodiment of the invention is shown on the accompanying drawings, in which.

DESCRIPTION OF THE PREFERRED EMBODIMENT

The machine of the present invention produces sealed packets or pouches and fills them with a flowable material, such as, for example, sugar, mayonnaise and catsup. The packets are formed of paper suitably coated so that sealing can be effected with heat or cold pressure sensitive material can be employed. Other than paper, the sheet material may be plastic, film, metal foil, or combinations thereof, depending upon the product to be packaged.

Figure 1:
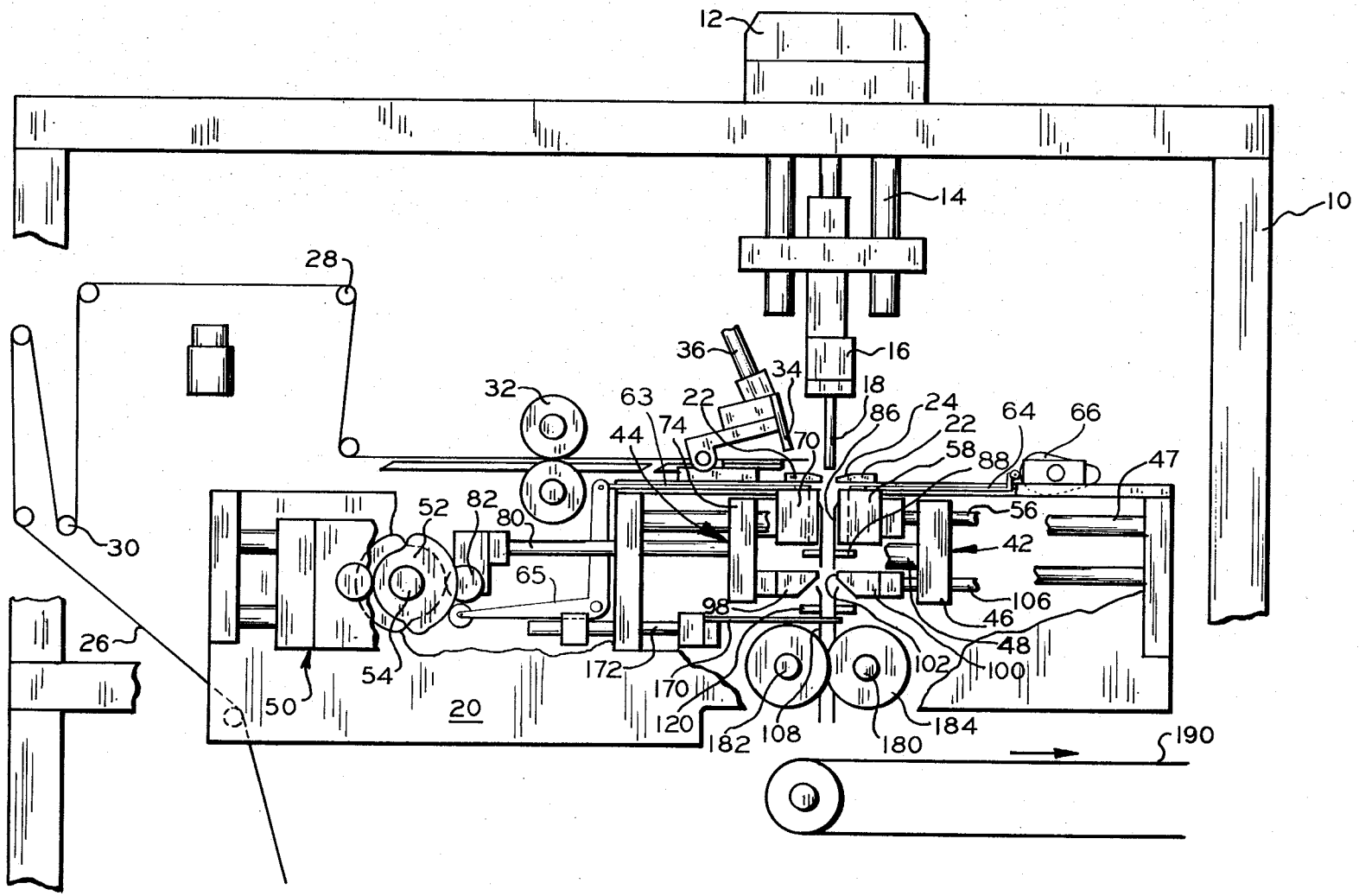
FIG. 1 is a side elevation of a machine for making and filling sheet material packets, the same being somewhat diagrammatic with parts broken away for purpose of clarity, the power means and certain of the operative connections being omitted since they, per se, form no part of the invention and are well within the province of a mechanic skilled in this art.
Figure 2:
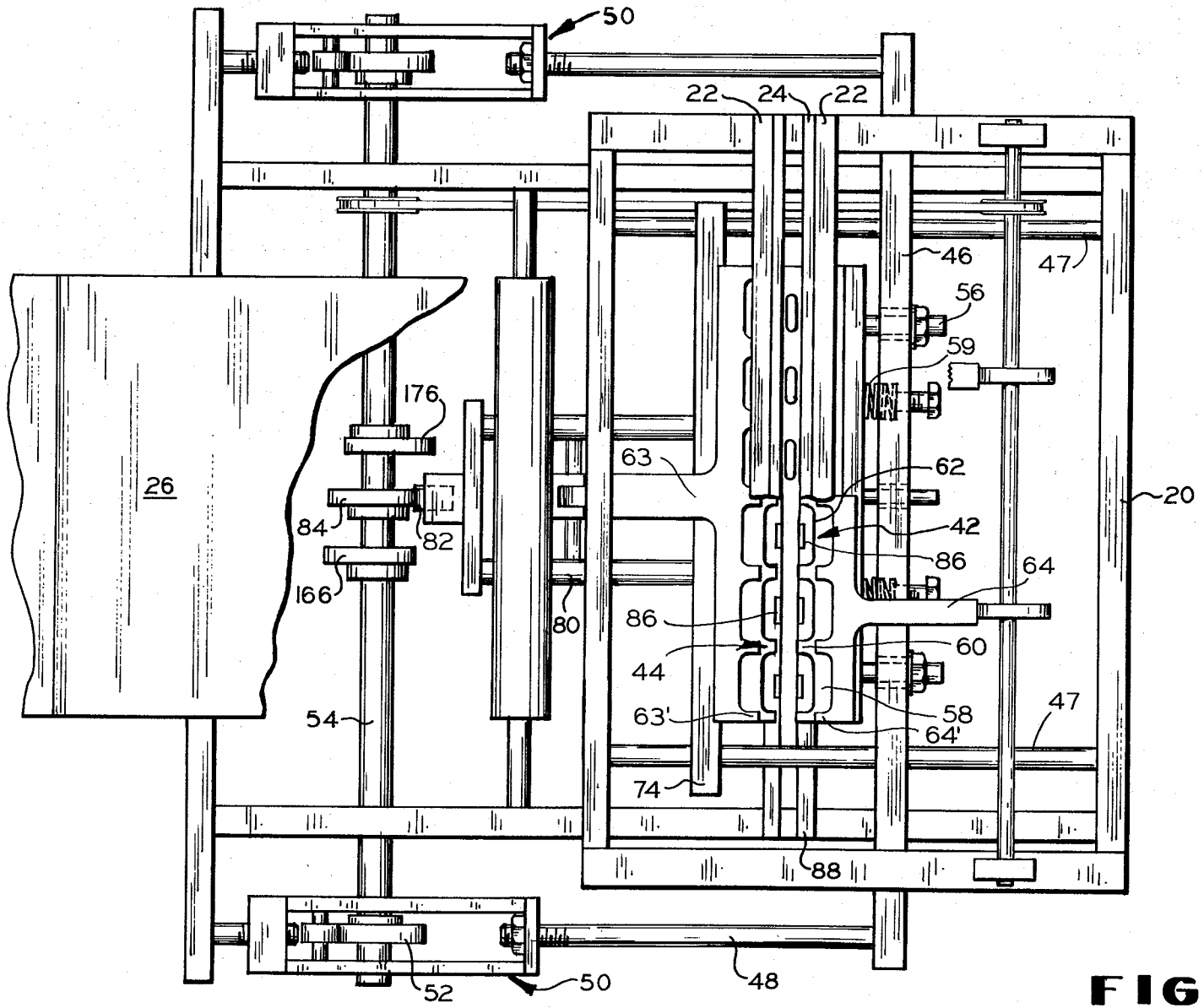
FIG. 2 is a top plan view of the machine shown in FIG. 1 with sheet severing knife and filler tubes removed and a portion of the folding plates broken away.
Figure 3:
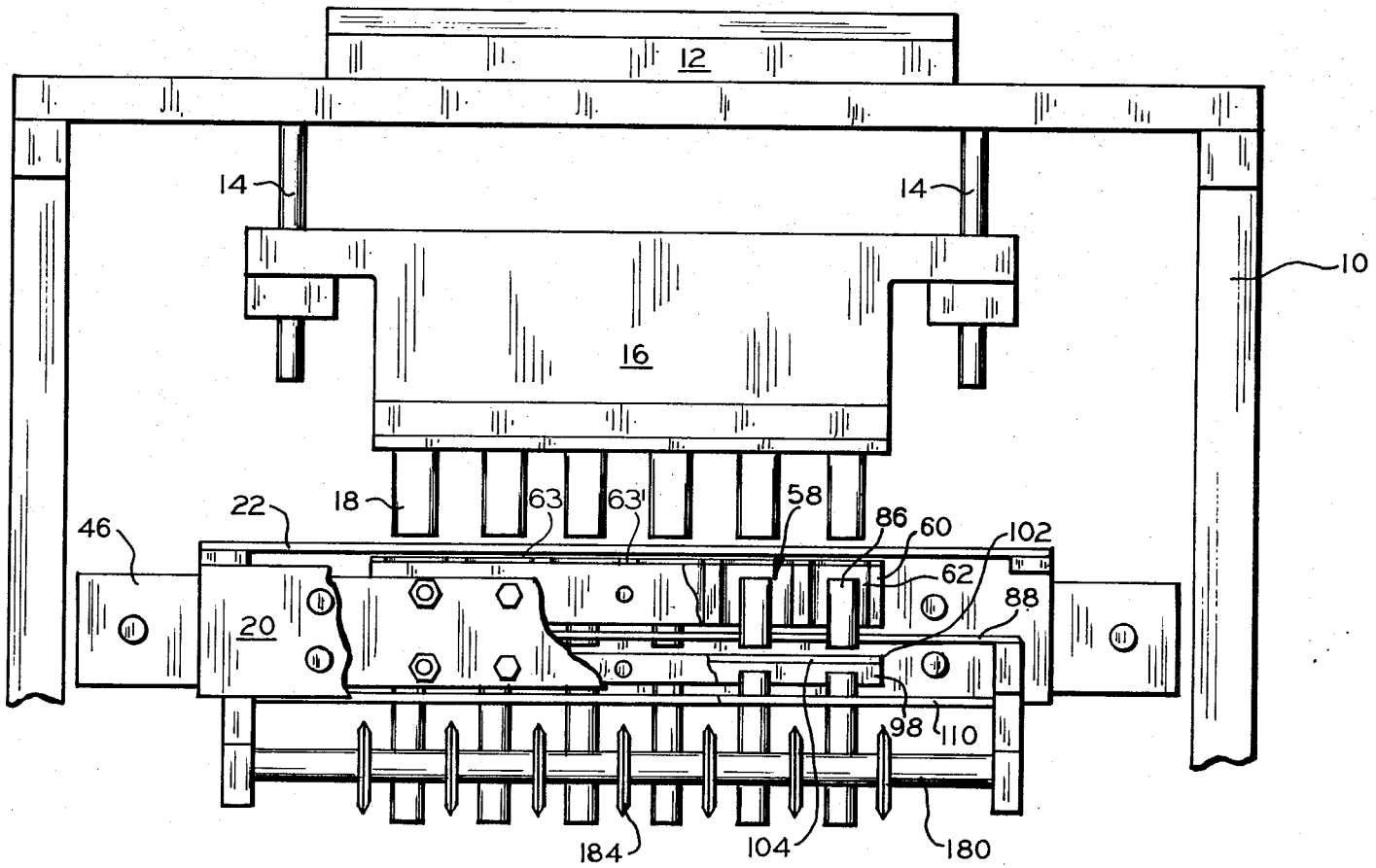
FIG. 3 is a fragmentary end view of the machine shown in FIG. 1 with some parts broken away.

Referring to FIG. 1, the machine has an outer main frame 10 which supports an elevated product supply housing or reservoir 12 from which the product is metered in any suitable manner. Metering devices are old in the art so that detailed description is not considered necessary. Suffice it to say that in timed relation, predetermined increments of product to be packaged are discharged to a series of laterally spaced vertical filling and forming tubes 18 which are carried by a depending mounting 16. The mounting 16 is vertically reciprocated on a frame 14 by crank means, for example (not shown). The filling and forming tubes 18 have end walls joined by side walls. This structure is of importance in producing an improved packet or pouch of unique form and sizeable volume.

Figure 4:
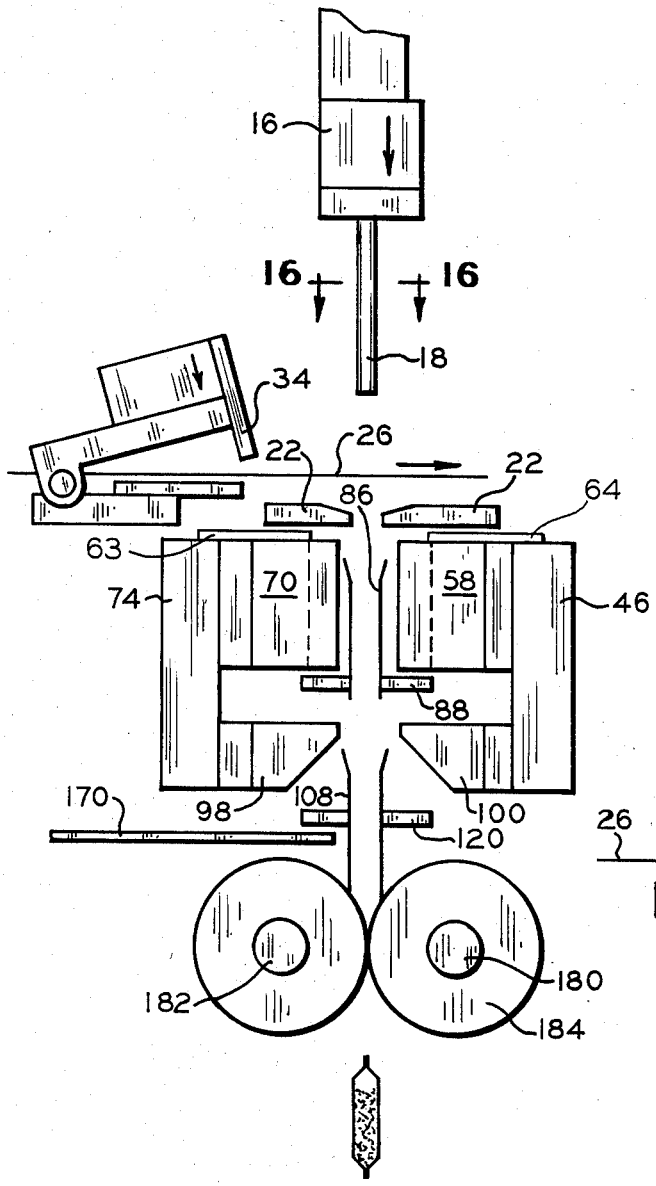
FIGS. 4 to 11 are somewhat diagrammatic views showing the sequence of operation of the various parts for folding the packet strips, side and top sealing the same, and delivering a product charge to each packet.

An inner machine frame 20 has a pair of horizontally extending laterally spaced folding plates 22 having spring loaded finger members 24 over which the leading end portion of a paper web 26 is advanced. The paper web 26 is typically comprised of a composite laminate of paper and a heat sensitive plastic film. The composite paper web 26 is fed from a suitable supply (not shown) and is caused to pass over a series of guide rolls 28 including a dancer or tensioning roll 30. The paper web 26 is recurrently advanced to the folding plates 22 by suitably driven cooperating upper and lower feed rolls 32, which may have any suitable non-slip surface. The paper web 26 is successively severed into packet-forming sections A (FIG. 4 et seq.) by a pivotally mounted cutter or knife 34, which extends entirely across the web 26. An actuating arm 36 actuates the knife in timed relation to the paper web advancing movement by suitable mechanism, not shown.

Beneath the slot formed by the laterally spaced forming plates 22 is a sealing jaw assembly which includes a pair of laterally opposed relatively moveable jaw units 42 and 44 for sealing the two parallel sides of the packet as hereinafter will more fully appear. The jaw unit 42 has a transverse jaw support beam 46 which may slide to and fro on guide pins 47. Actuating arms 48 connected to the ends of the support 46 have cam follower devices 50, respectively, which operatively engage cams 52 on a suitably driven cam shaft 54. The beam 46 is guided in its movements by upper slide pins 56, the inner ends of which are secured to an elongate jaw sealing unit 58. Suitable springs 59 are provided to absorb and cushion the working thrust when jaw sealing movement is effected.

The working face of the jaw sealing unit 58 has a plurality of clamping heads 60 provided with a series of serrations for pressing against the paper web section to effect contact of the facing pressure sensitive film laminate and thereby cause a heat pressure sealing of the opposite sides of the respective packet. An inwardly extending groove 62 is provided between each pair of serrated heads 60. The heads 60 extend entirely across the jaw unit 58 so that a multiplicity of packets can be side sealed during a single operation.

Arranged opposite to and in cooperating relation to the jaw unit 58 and forming part of the jaw unit 44 is a similar arrangement of serrated clamping heads 70 which are adapted to abut against the heads 60 for effecting the desired sealing action. For the clamping heads 70, there is a transverse support 74 which is reciprocated by actuating arms 80. A cam follower 82, carried by the arms 80, operatively engages a cam 84 on the cam shaft 54. The support 74 is guided in its reciprocatory movement by the slide pins 47.

As the multiple packet strip gravitates between the jaw units 42 and 44, its movement is somewhat restrained and guided by a series of upper leaf spring fingers 86 having outwardly flared upper ends and arranged in facing relation on opposite sides of the path of travel of the packet strip. The spring fingers are contained in the region of the respective grooves 62 so as to lie therein when the jaw units are brought into sealing operation. Each series of spring fingers is secured to an elongate support bar 88 suitably secured at its ends to the machine frame.

Beneath the spaced forming plates 22 and slightly above the upper jaw units 70 and 58 is a gripping jaw assembly which includes a pair of laterally opposed relatively moveable gripping members 63 and 64 for gripping the uppermost zone of the top of the packet immediately above the side seals formed by the jaw units 70 and 58, respectively. Typically, the gripping member 63 is driven in timed to and fro movement by a suitable cam member mounted on the shaft 54 through a cam follower and lever arrangement 65. The cooperating gripper member 64 is driven in a timed sequence with the gripping member 63 by a cam and cam follower arrangement 66.

The working faces of the gripping members 63 and 64 are provided with a plurality of vertical ribs 63' and 64' respectively spaced apart to be in general vertical alignment with the serrated portions of the jaw units 70 and 58.

Secured to and moveable with the upper jaw units 70 and 58 and disposed below and in parallel relation are sealing units 98 and 100, respectively, for sealing the top of the elongate packet strip. Each of the units 98 and 100 has a relatively narrow clamping head 102 adapted to abut against each other. The heads 102 have an unbroken series of serrations 104 on their faces. As shown, the sealing unit 98 is fixed to and moveable with the support 74. The unit 100 is guided in its reciprocatory movements by guide pins 106 and is fixed to the support 46 for conjoint movement with the upper sealing jaw 58.

Beneath the sealing jaws 98 and 100 and in alignment with the spring fingers 86, respectively, are similar leaf spring fingers 108 arranged on opposite sides of the jacket strip travel and in similar facing relation. The upper ends of these leaf spring fingers are outwardly flared and they are secured at their lower ends to a horizontal bar 110 fixed at its ends to the machine frame.

Beneath the top sealing jaws 98 and 100 is a stop plate unit 170 which shifts to and fro horizontally and may be adjustable vertically to properly locate the top seal of the packet. When the gripping jaws 63 and 64 are in operative packet strip gripping position, the lower stop plate unit 170 is out of the way or in inoperative position. The unit 170 is actuated by a rod 172 which has an operative connection (not shown) with a cam 176 on the cam shaft 54.

After sealing of the packet strip to provide side and top seals, the strip is severed to provide separate individual packets. This is achieved by circular cutters or knives 184 mounted in laterally spaced relation on suitably driven shafts 180 and 182, respectively. The cutting equipment is disposed directly beneath the lower stop plate unit 170 so that the packet strip drops between the shafts 180 and 182 and severance of the several packets is made at one time.

The severed packets then drop upon an endless conveyor 190 which carries them to a subsequent packet handling station, for example, at a location remote from the machine.

OPERATION OF THE MACHINE

Figure 5:
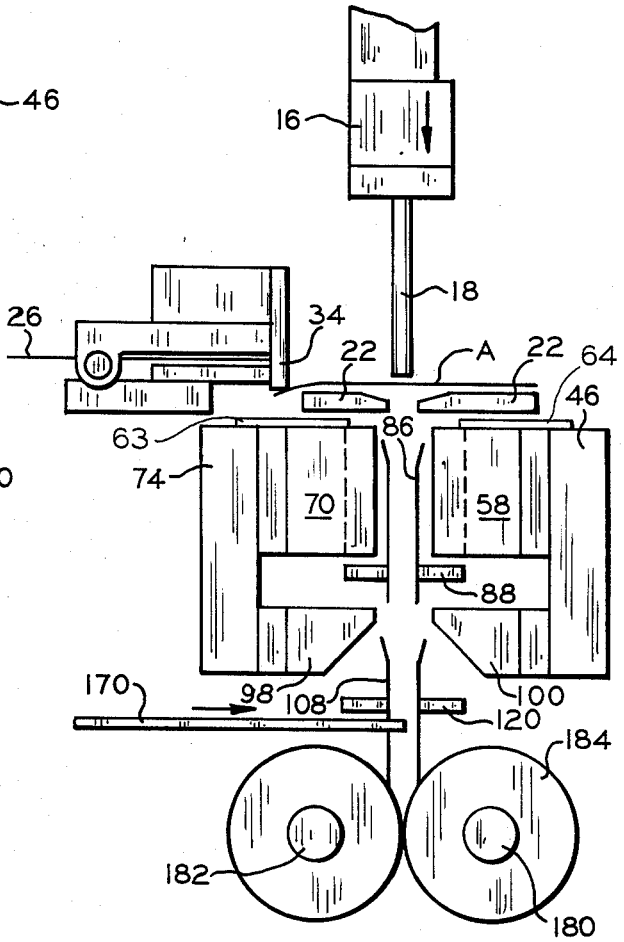
Figure 6:
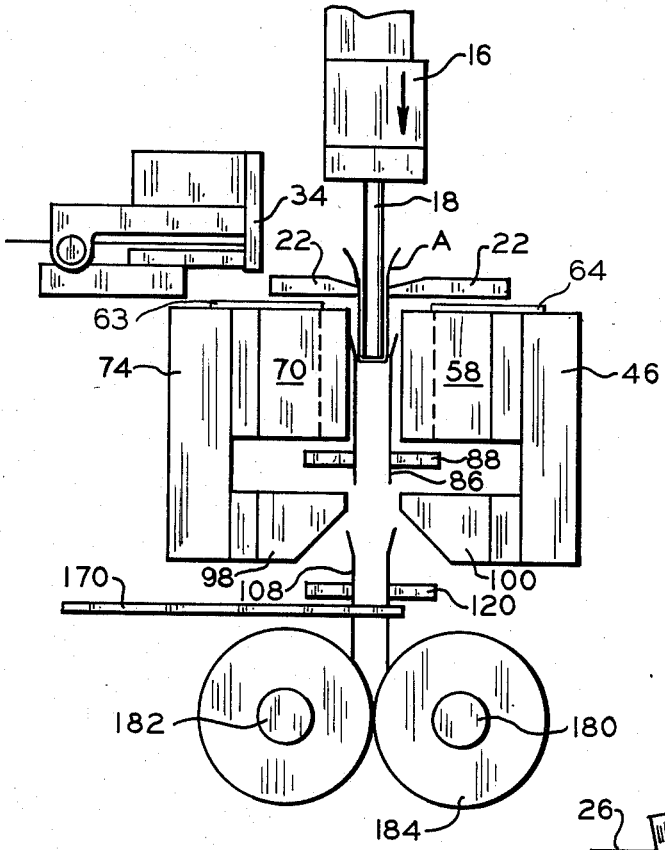

FIGS. 4 to 11 somewhat diagrammatically illustrate the steps involved in the forming of the packet, the sealing of same, as well as the filling of packet with the free flowing product. In the step by step operation, the sheet material 26 is intermittently advanced by the feed rolls 32 to a predetermined extent sufficient to form a plurality of packets. When adequate sheet material has been fed beyond the cutter knife 34, the latter is rocked to sever a segment as strip A during a pause in the advancing movement of the sheet supply 26 (FIG. 5). Slightly prior to the cutting operation, the battery of filling tubes 18 start to move downwardly and engage the center portion of the strip A causing it to fold between the folding plates 22 (FIG. 6).

Figure 7:
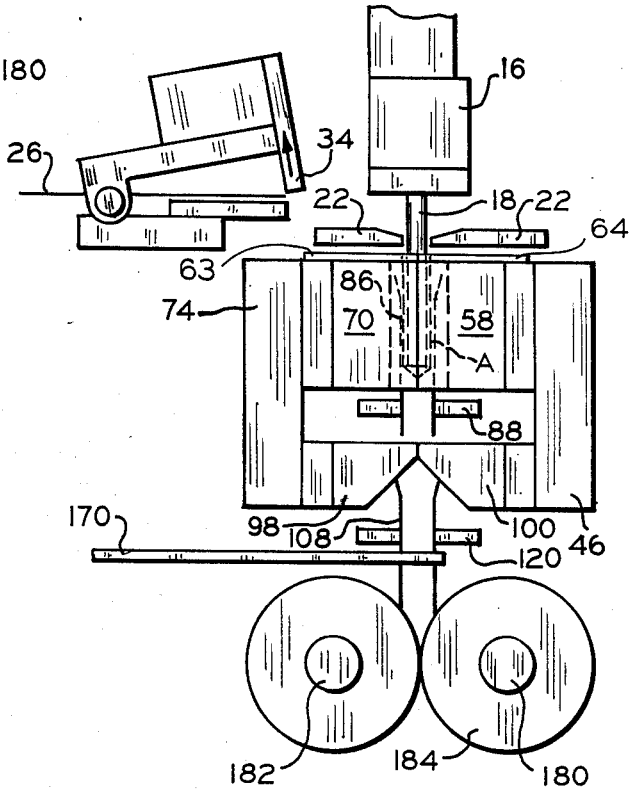

The filling tubes 18 continue their downward movement, and the spring fingers 86 are in guiding relation with the sides of the strip A and the associated filling and forming tubes 18. The side clamping jaw units 58 and 70 are actuated to clamping position when the upper free ends of the strip A are substantially within the jaws (FIG. 7). Substantially simultaneously with the actuation of the jaw units 58 and 70, the gripping members 63 and 64 are actuated to effect a gripping of spaced portions of the upper portions of the strip A. At this time, the sides of the packets are sealed together due to the heat and pressure imposed on the strip by the jaw sealing units 58 and 70, thus leaving only the upper end of the packets opened. As mentioned, this may involve pressure sensitive adhesive on the strip A or heat may be applied in a well known manner to the sealing jaws for effecting sealing by the use of heat sensitive material.

Figure 8:
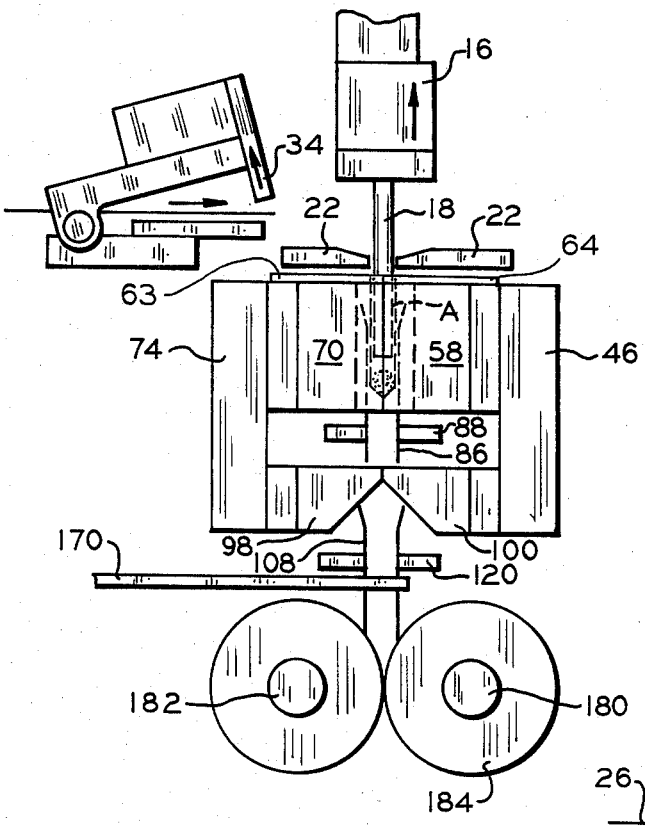
Figure 9:
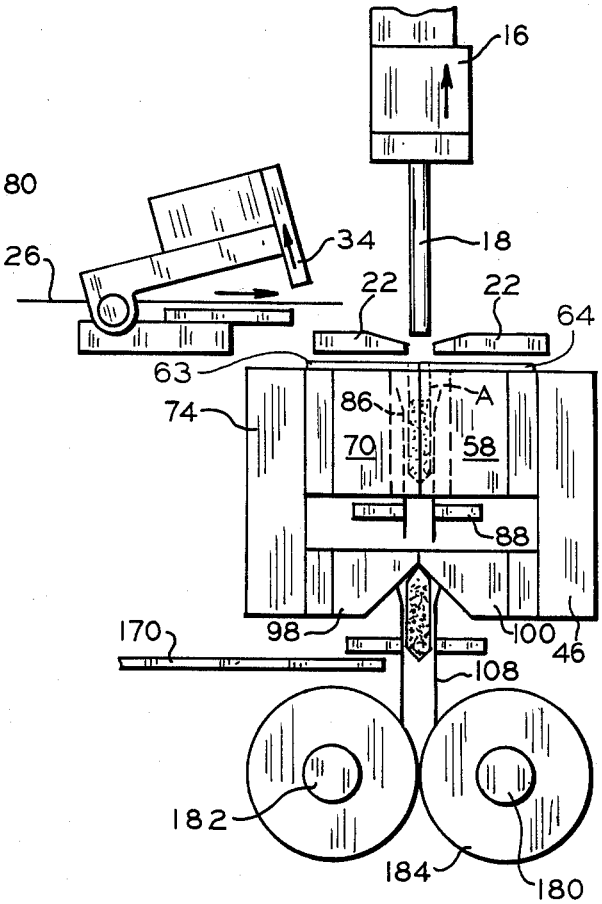
Figure 10:
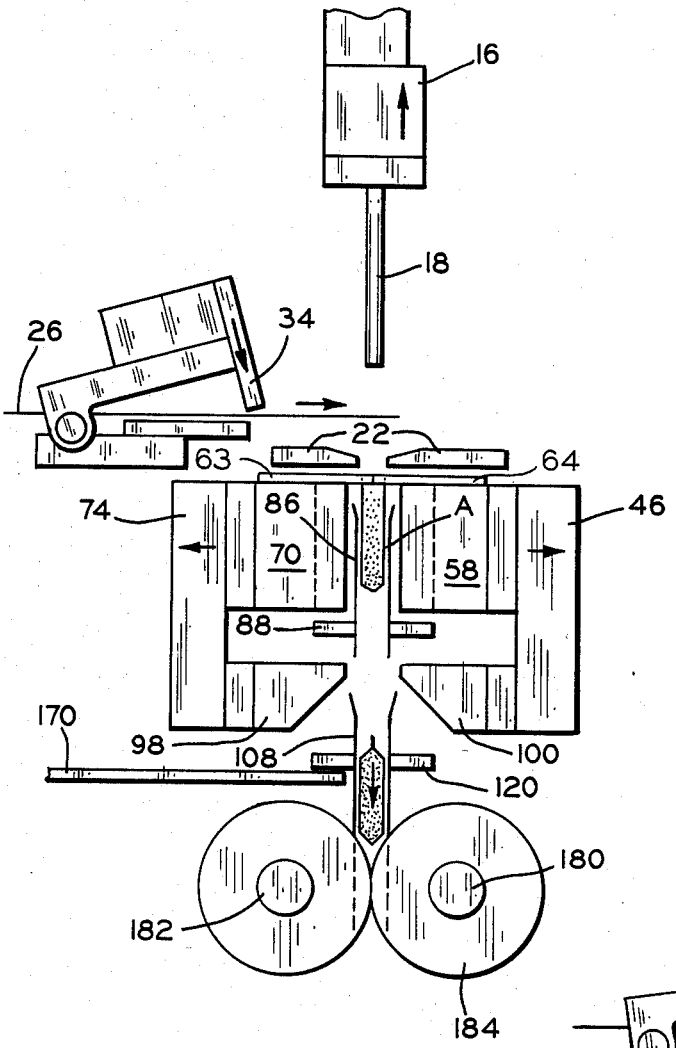
Figure 11:
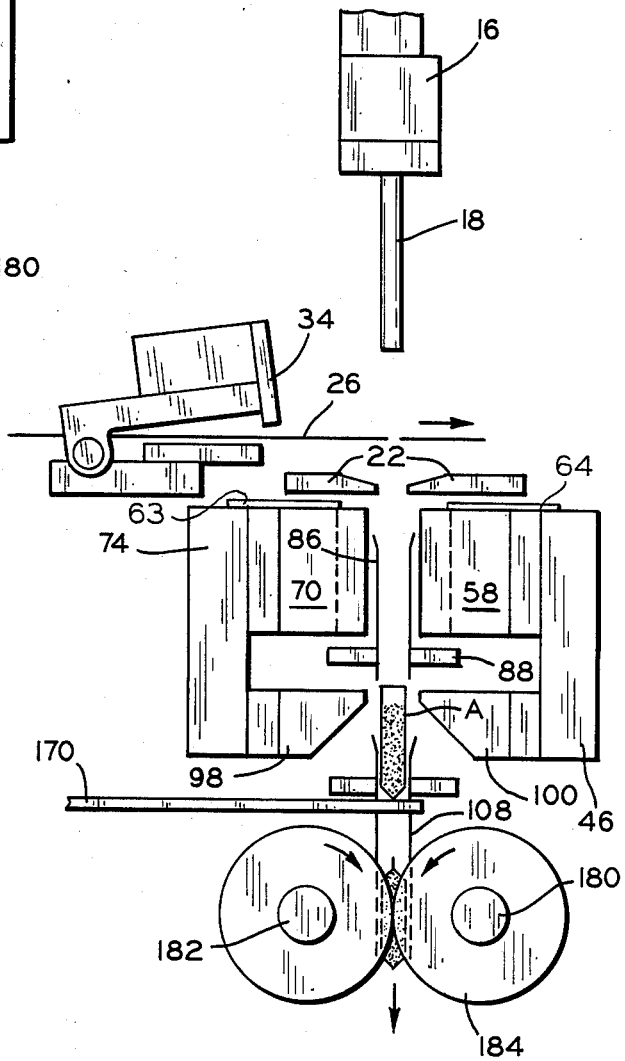

As soon as the filling and forming tubes 18 start their upward movement, the product is deposited into the associated formed packet, as illustrated in FIG. 8. Just prior to moving upward, a quantity of the product is metered by any suitable means from the filling tubes into the formed pouches or packets while the gripping units and clamping units remain closed. The clamping jaw units are then caused to retract as illustrated in FIG. 10. The formed and filled strip A is held in the position illustrated in FIG. 10 until the gripping jaws 63 and 64 are retracted, as illustrated in FIG. 11 whereupon the strip A drops to the stop plate 170 which has just moved into position of use. While the open ended packet strip A is in this position, the top portion of the strip is ready to be sealed by the sealing jaws 98 and 100.

A new packet strip A has now commenced its downward movement (FIG. 8) so that simultaneously the side portions of one packet strip and the top portions of the preceding packet strip are sealed. In the next step, illustrated in FIG. 10, the lower stop plate 170 retracts, the sealing clamping jaws retract, and the lower packet strip drops to the severing station where the circular cutters 184 sever the strip into individual filled packets. These are then conveyed away from the machine by the conveyor 190.

It should be noted that the conformation of the filler tubes 18 is important in determining the final shape of the individual packets. It is also noteworthy that the filling tubes 18 remain in place between the clamping jaws 58 and 70, not only during the side sealing of the packet strip A, but also as the product is discharged into the packet cavities.

Figure 12:
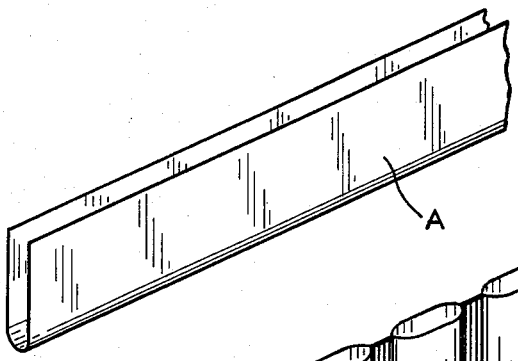
FIGS. 12 to 15 are perspective views showing, in sequence, the folding of the packet strip, the multiple side sealing step, the continuous top sealing step, and the severing of the packet strip to form individual packets.
Figure 13:
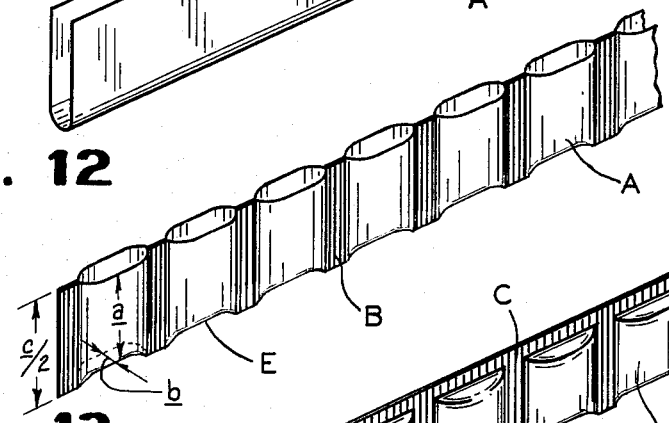
Figure 14:
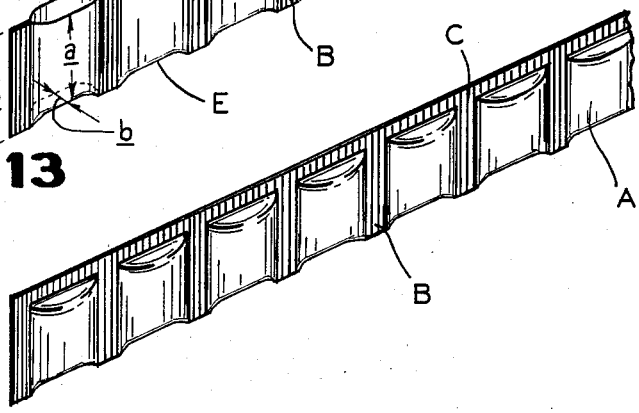
Figure 15:
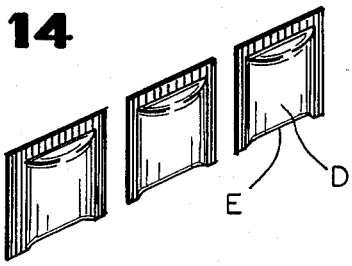

Reference is made to FIGS. 12 to 15 which illustrate how the packet strip A is first folded upon itself, the side walls facing each other in parallel relationship and the fold conforming with the configuration of the side edge portions of the bottom of the folding and filing tube 18 (FIG. 12). In FIG. 13 the side edges B of the packet strip are sealed thereby forming open mouth cavities or pouches (FIG. 13). Then FIG. 14 shows the next step in which the top C of the packet strip is sealed. Finally, in the side sealing areas, the packets are severed from the strip as shown in FIG. 15.

PACKET STRUCTURE

Figure 16:
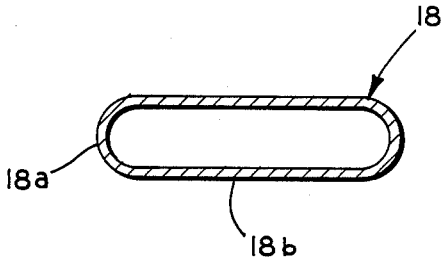
FIG. 16 is an enlarged transverse section taken along line 16—16 of FIG. 4 to show the formation of a filling tube.
Figure 17:
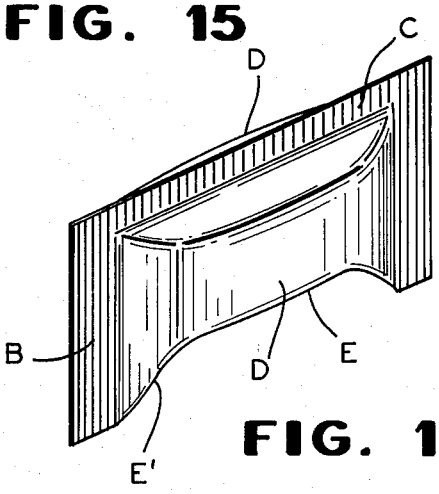
FIG. 17 is an enlarged perspective view of a filled packet as finally formed.

The form of the final packet is important because it has increased product capacity, storage, and display advantages. It will be noted in FIGS. 15 and 17 that the side walls D of the packet bow curvilinearly outwardly on each side of the flat sealing areas B and the bottom E tends to be flat between the serrated sealed side portions B, the flattened portion being spaced upwardly from the free lower ends of the side seals B to which the flat bottom portion is connected by inwardly and upwardly inclined bottom portions of ears E'. Thus, the curvilinear side walls enhance the capacity of the conventional packets as illustrated in U.S. Pat. No. 3,404,506. The flat bottom E contributes to ability of the packet to be supported in an upright position and conservation of space. This packet formation is the result of the shape of the filling tubes 18 which, as shown in FIG. 16, is provided with outwardly curved end walls 18*a* and interconnecting side walls 18*b*. The configuration of the flat bottom E, as the inclined portion E' permits foreshortening of the width of the strip by the sealing jaws without causing wrinkling of the sealed edges.

The open packet (shown in FIG. 13) formed according to the principles of the present invention can be defined mathematically. If the length of the packet strip A is represented as c, then the length of each of the flat sealing areas B will be c/2. The length of each of the side walls D (before the top C is sealed) is a, while the length of the flat bottom E is b, such that $2a+b=c$.

Although a preferred embodiment of the invention has been shown and described, the same have been given by way of illustration and not of limitation and changes may be made in details of construction and operation and choice of materials without departing therefrom.

What is claimed is:

1. A method of producing at least one sealed packet filled with a product, comprising the steps of:

(a) providing a generally horizontally disposed individual segment of sheet packaging material at a predetermined position;

(b) urging a central portion of the individual segment vertically downwardly relative to the side portions of the segment to form a channel-shaped member having a bottom wall and vertically extending spaced apart opposed side walls;

(c) maintaining a vertically extending selected portion of the opposed side walls in generally parallel spaced apart relationship;

(d) simultaneously with step (c), sealing the opposed side walls together at horizontally spaced apart locations positioned on opposite sides of said selected portion and extending upwardly from the bottom wall toward the upper end of the side walls for producing at least one cavity open at the upper end;

(e) subsequent to step (d), filling the cavity with a product; and (f) sealing the upper edge portions of the opposed walls of the channel-shaped member together to close the upper end of the cavity whereby a filled sealed packet is produced.

2. The method as defined in claim 1 wherein step (d) includes the step of simultaneously sealing the opposed side walls at a plurality of horizontally spaced apart locations for producing a plurality of cavities each having an open upper end.

3. The method as defined in claim 1 wherein step (d) includes the step of maintaining the bottom wall relatively flat during the side sealing operation.

4. The method as defined in claim 1 wherein the side sealing operation of step (d) is performed at a location which is vertically spaced from the location at which the upper edge sealing operation of step (f) is performed.

5. The method as defined in claim 1 wherein steps (d) and (f) are performed simultaneously on separate channel-shaped members.

6. A packaging machine for producing at least one sealed packet filled with a product comprising, in combination:

forming means for urging a central portion of a generally horizontally disposed individual segment of sheet packaging material vertically downwardly relative to the side portions of said segment to form a channel-shaped member having a bottom wall and vertically extending opposed side walls;

side sealing means for sealing said opposed side walls together at horizontally spaced apart locations positioned on opposite sides of a vertically extending selected portion of the opposed side walls, said sealing locations extending vertically upwardly from the bottom toward the upper end of the side walls for producing at least one cavity open at the upper end, said side sealing means including means for maintaining said selected portion of the opposed side walls in generally parallel spaced apart relationship during the side sealing operation;

means for filling the cavity with a product after said side sealing means completes the side sealing operation; and top sealing means for sealing the upper edge portions of said opposed side walls of said channel-shaped member together to close the upper end of said cavity whereby a filled sealed packet is produced.

7. A packaging machine for producing at least one sealed packet filled with a product comprising, in combination:

means for feeding a strip of sheet packaging material along a horizontally disposed longitudinally extending path to a predetermined position;

means for severing said sheet of packaging material transversely of the longitudinal path for producing a generally horizontally disposed segment of packaging material at the predetermined position;

vertically reciprocal forming means for urging a central portion of said segment vertically downwardly relative to the side portions of said segment to form a channel-shaped member having a bottom wall and vertically extending opposed side walls;

side sealing means for sealing said opposed side walls together at horizontally spaced apart locations positioned on opposite sides of a vertically extending selected portion of the opposed side walls, said sealing locations extending vertically upwardly from the bottom toward the upper end of the side walls for producing at least one cavity open at the upper end, said side sealing means including means for maintaining said selected portion of the opposed side walls in generally parallel spaced apart relationship during the side sealing operation;

means for filling the cavity with a product; and top sealing means for sealing the upper edge portions of said opposed side walls of said channel-shaped member together to close the upper end of said cavity whereby a filled sealed packet is produced.

8. The packaging machine as set forth in claim 7 wherein said vertically reciprocal forming means includes a filling tube means for engagement with the transversely extending central portion of said segment, and said means for filling includes means for discharging a product into said cavity through said filling tube.

9. The packaging machine as set forth in claim 7 wherein said forming means and said side sealing means are operable to simultaneously form a plurality of individual, horizontally spaced apart cavities, each having an open upper end.

10. The packaging machine as set forth in claim 7 wherein said side sealing means is vertically spaced from said top sealing means, and means for transferring said channel-shaped member having said cavity from said side sealing means to said top sealing means.

* * * * *